United States Patent [19]

Gilbert et al.

[11] 4,024,078

[45] May 17, 1977

[54] LIQUID DETERGENT COMPOSITION

[75] Inventors: Lawrence A. Gilbert, Fairfield; John W. Schuette, Cincinnati, both of Ohio

[73] Assignee: The Procter & Gamble Company, Cincinnati, Ohio

[22] Filed: Mar. 31, 1975

[21] Appl. No.: 563,533

[52] U.S. Cl. ..... 252/551; 252/526; 252/528; 252/545; 252/547; 252/557

[51] Int. Cl.[2] ..... C11D 1/14; C11D 1/74; C11D 3/06

[58] Field of Search ..... 252/551, 532, 528, 547; 260/458

[56] References Cited

UNITED STATES PATENTS

| | | | |
|---|---|---|---|
| 2,766,212 | 10/1956 | Grifo | 252/551 X |
| 2,861,956 | 11/1958 | Fernandez | 252/153 |
| 3,085,982 | 4/1963 | Steer et al. | 252/532 |
| 3,332,876 | 7/1967 | Walker | 252/551 X |
| 3,336,387 | 8/1967 | Finch et al. | 260/583 |
| 3,350,319 | 10/1967 | Schonfeldt | 252/532 |
| 3,501,409 | 3/1970 | Matson et al. | 252/559 X |
| 3,775,349 | 11/1973 | Tuvell et al. | 252/547 |
| 3,786,003 | 1/1974 | Hunter | 252/551 |
| 3,793,233 | 2/1974 | Rose et al. | 252/547 |
| 3,898,187 | 8/1975 | Miller | 252/553 |

FOREIGN PATENTS OR APPLICATIONS

| | | |
|---|---|---|
| 279,352 | 1/1965 | Australia |
| 1,436,283 | 3/1966 | France |
| 684,595 | 8/1967 | South Africa |
| 1,082,076 | 9/1967 | United Kingdom |

OTHER PUBLICATIONS

"Use Evaluation of Alcohol Derivatives in Detergent Formulations", Matson, T. P., Journal of American Oil Chem. Society, vol. 40, Nov. 1963, pp. 636–640.

*Primary Examiner*—P.E. Willis, Jr.
*Attorney, Agent, or Firm*—Forrest L. Collins; Robert B. Aylor; Thomas H. O'Flaherty

[57] ABSTRACT

A liquid detergent composition which is particularly effective in cleaning food-soiled surfaces while being mild to the skin is formulated from a mixture of decyl alcohol alkoxy sulfates having a high mono-alkoxylate content. Such compositions provide adequate sudsing over a range of water hardness.

24 Claims, 3 Drawing Figures

LIQUID DETERGENT COMPOSITION

BACKGROUND OF THE INVENTION

1. Field of the Invention

The present invention relates to compositions suitable for use in cleaning hard surfaces, particularly the hand washing of dishes.

2. Description of the Prior Art

Detergent compositions are formulated to provide as many consumer recognizable benefits as possible while minimizing the consumer recognizable negatives.

A detergent composition used to clean dishes or other food-soiled hard surfaces must first be effective in cleaning the soiled surface. Secondly, it is desirable that the detergent composition be mild to human skin if the product is to be used for hand dishwashing.

Alkyl sulfates and alkyl benzene sulfonates have frequently been used in liquid hand dishwashing compositions as the surface active agent of the composition. While these materials are very effective in cleaning food-soiled surfaces, they are undesirable from the standpoint that they may cause a harsh, reddened appearance to the skin when used at high concentrations or where the consumer's hands are exposed for prolonged periods of time to the dishwater containing these surface active agents.

It was proposed in U.S. Pat. No. 3,793,233, issued Feb. 19, 1974 to Rose et al, that the harshness of alkyl sulfates could be reduced by incorporation of high ethoxylate content alkyl ethoxy sulfates at a ratio of from about 2:1 to about 6:1 to the alkyl sulfate. The degree of ethoxylation of the alkyl ethoxy sulfate in the Rose et al patent is stated to be from about 5 to about 12 moles of ethylene oxide per mole of the alkyl ethoxy sulfate. The mainstay surface active agent in the Rose et al patent is, however, the alkyl sulfate as the alkyl ethoxy sulfates at the aforementioned levels of ethoxylation are not particularly effective surface active agents for the cleaning of soiled dishes.

To improve the performance of alkyl benzene sulfonates, it has been proposed in U.S. Pat. No. 3,231,504 to Marion et al, issued Jan. 25, 1966, that alkyl benzene sulfonates be combined with alkyl ethoxy sulfates at a respective weight ratio of from about 6.5:1 to about 1:4, and contains as an additional component, a water-soluble inorganic builder salt. The alkyl ethoxy sulfates used to improve the performance of the Marion et al composition are stated to have an alkyl chain length of from 10 to 18 carbon atoms, and a degree of ethoxylation of about 2 to 15, preferably 3 to 8 moles of ethylene oxide per mole of alkyl ethoxy sulfate.

Alkyl ethoxy sulfates of low ethoxy content have been used as the primary anionic detergent active primarily for their ability in cleaning rather than as a mildness additive with other anionic or nonionic detergent components. U.S. Pat. No. 3,179,598 issued to Smith, Apr. 20, 1965, teaches a detergent composition containing from about 20% to 40% by weight of an alkyl ethoxy sulfate wherein the alkyl portion is a straight chain radical having from about 10 to 14 carbon atoms wherein at least 50% of the alkyl groups have 12 carbon atoms and the degree of ethoxylation is between 0 and 4. These alkyl ethoxy sulfates are used in combination with a trialkyl (tertiary) amine oxide, having one straight chain alkyl group with from 10 to 14 carbon atoms and two short chain alkyl groups having 1 or 2 carbon atoms. The ratio of the alkyl ethoxy sulfate in the Smith patent to the amine oxide is from about 3:1 to about 7:1. In U.S. Pat. No. 3,179,599, issued to Eaton and Gebhardt on Apr. 20, 1965, an alkyl ethoxy sulfate is again used as the primary anionic surface active agent in combination with a tertiary amine oxide both having the description given in the Smith patent, supra, and as an additional component, and alkyl glyceryl ether sulfonate having from about 10 to 14 carbon atoms.

The improvement of the Eaton and Gebhardt patent over that of Smith is stated to be in the addition of the alkyl glyceryl ether sulfonate which lowers the sudsing sensitivity of the combination of the alkyl ether sulfate and the amine oxide under acidic conditions. Sudsing, that is the ability of a dishwashing composition to generate and maintain an adequate suds level during use is an important variable in such compositions. Consumers have for years related the cleaning ability of soaps and synthetic detergents to their ability to generate and maintain copious amounts of suds in the wash solution. Moreover, consumers have been unwilling to accept liquid dishwashing compositions which do not provide such sudsing characteristics. Thus, in order to meet consumer aesthetics, it is necessary to prepare a detergent composition which is not only effective in cleaning and mild to the skin but which also generates and maintains an adequate suds level in the wash water.

Whereas, Eaton and Gebhardt were concerned with the pH of the wash solution and its relationship to the generation and maintenance of adequate suds levels, it has been stated in U.S. Pat. No. 3,332,878 to Coward et al issued July 25, 1967, that small amounts of the water-soluble salts of magnesium and calcium such as those of the sulfate and chloride ions, may be added to the liquid detergent composition to provide increased suds stability during usage of the product. The addition of the water-soluble salts taught by Coward et al and those disclosed in South African Patent Application 68/4594; namely, copper, iron, zinc and aluminum salts, while providing increased suds stability, are very detrimental to the initial suds generation over a wide range of water hardness.

Tuvell et al in U.S. Pat. No. 3,775,349 issued Nov. 27, 1973, discloses that mixtures of alkyl sulfates and alkyl alkoxy sulfate detergents perform better if large quantities of the alkyl radical are decyl.

A more particular description of the alkyl sulfate and alkyl alkoxy sulfate detergents described in the Tuvell et al. patent provides that the alkyl radical should have from 10 to 20 carbon atoms wherein about 10% to 50% of the alkyl groups are decyl and the alkoxy moiety is either an ethoxy or isopropoxy radical averaging from 2 to 4 moles of alkoxy per mole of alkyl alkoxy sulfate. The Tuvell et al. patent states that other adjuvants may be used in combination with the alkyl alkoxy sulfates such as tertiary amine oxides, alkyl benzene sulfonates and fatty acid ethanol amides.

Tuvell et al while disclosing that a high concentration of decyl radicals are desirable in a dishwashing composition, does so in the context that large amounts of decyl sulfates are present and are used to lower the average ethoxylate content to the claimed range of from 2 to 4 alkoxy units per decyl radical. While the decyl sulfates are useful in cleaning food-soiled surfaces, they are eminently harsh to human skin — such that prolonged exposure can lead to cracked and chapped, reddened hands. The decyl alkoxy content average of from 2 to 4 moles per decyl unit has a tendency to reduce the skin irritation caused by the unalkoxylated decyl sulfate. However, in order to achieve the average alkoxy content taught by Tuvell et al a large amount of alcohol alkoxylated sulfates of higher than four alkoxy units must be used and cleaning performance is substantially diminished.

It has now been found that a liquid detergent composition which is particularly effective in cleaning dried-on food soils is prepared using a mixture of decyl alcohol alkoxy sulfate having a mean alkoxy content of from about one to about four wherein a specified minimum percentage of the mono-alkoxylate is present in the composition.

It is thus an object of the present invention to prepare a liquid detergent composition which is effective in the removal of food soils.

It is another object of the present invention to provide a detergent composition which while being eminently effective in the removal of food soils, exhibits decreased harshness to the skin.

It is yet a further object of the present invention to prepare a detergent composition which provides adequate initial suds generation over a range of water hardness.

A further object of the present invention is to provide a detergent composition with increased suds stability over a range of water hardness.

It is still yet another object of the present invention to provide a detergent composition which is effective in cleaning, mild to the skin, and which at the same time provides adequate initial suds generation and suds stability during the wash, even upon the addition of substantial amounts of hardness ion to the composition.

Throughout the specification and claims, percentages and ratios are by weight and temperatures are in degrees Fahrenheit unless noted otherwise. When the weight percentage of the alkyl alkoxy sulfate is given it is based on the weight of the ammonium salt. The art recognized terms alkyl alkoxy sulfate, alcohol alkoxy sulfate and alkyl ether sulfate and their derivatives are used interchangeably.

SUMMARY OF THE INVENTION

A liquid detergent composition comprising: (a) from about 4% to about 80% by weight of a mixture of decyl alcohol alkoxy sulfates wherein the alkoxy radical is selected from the group consisting of ethoxy and isopropoxy radicals and mixtures thereof having a mean alkoxy content of from about one to about four wherein at least about 20 by weight of the decyl alcohol alkoxy sulfates are monoalkoxylated and; (b) from about 20% to about 96% by weight water.

DETAILED DESCRIPTION OF THE INVENTION

Figure 1:
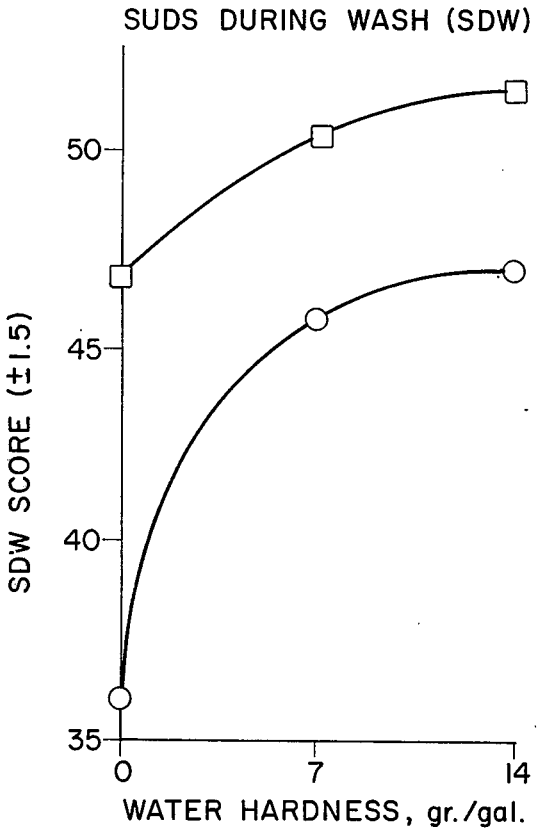

The decyl alcohol alkoxy sulfates described above are prepared by selecting the appropriate alkyl chain length; namely, that of decyl alcohol or a mixture of fatty alcohols such that the final composition contains from about 10% to about 80%, preferably about 15% to about 60%, and most preferably from about 20% to about 50% by weight of the decyl alcohol alkoxy sulfate. When other fatty alcohols are to be alkoxylated and sulfated, the carbon chain length utilized is from about 12 to 20 carbons and preferably, the ($C_{12}$) and tetradecyl ($C_{14}$) alcohols predomonate. The degree of alkyl branching of the decyl alcohols used to prepare the decyl alkoxy sulfates, as well as the other fatty alcohols so processed, is discussed later.

Decyl alcohol does not substantially occur in nature as is shown in a typical middle cut coconut mixture shown in Table I, below. Natural coconut mixtures contain about six percent decyl radicals.

Table I $CNE_3^-SO_4^-NH_4^+$ ALKYL CHAIN LENGTH AND ETHOXYLATE (EO) DISTRIBUTIONS*

| | Composition (Wt. %) | | | | |
|---|---|---|---|---|---|
| | Alkyl Chain Lengths | | | | Total of Ethoxylate for All Alkyl Chains |
| EO | $C_{10}$ | $C_{12}$ | $C_{14}$ | $C_{16}$ | |
| 0 | .08 | 9.87 | 3.99 | 1.01 | 15 |
| 1 | .06 | 7.90 | 3.19 | .80 | 12 |
| 2 | .07 | 9.21 | 3.72 | .94 | 14 |
| 3 | .07 | 8.55 | 3.46 | .87 | 13 |
| 4 | .06 | 7.90 | 3.19 | .80 | 12 |
| 5 | .05 | 6.58 | 2.66 | .67 | 10 |
| 6 | .04 | 5.26 | 2.13 | .54 | 8 |
| 7 | .03 | 3.95 | 1.60 | .40 | 6 |
| 8 | .02 | 2.63 | 1.06 | .27 | 4 |
| 9 | .02 | 1.97 | .80 | .20 | 3 |
| 10 | .01 | 1.32 | .53 | .13 | 2 |
| 11 | .01 | .66 | .27 | .07 | 1 |
| Total of All Ethoxylates per Alkyl Chain | .5 | 65.8 | 26.6 | 6.7 | 100 |

A source of substantially unbranched decyl alcohol is obtained by hydrolyzing the aluminum alkoxides derived from the reaction product of ethylene and lower alkyl aluminum compounds as is described in U.S. Pat. No. 3,415,861, issued Dec. 10, 1968, to W. T. Davis et al incorporated by reference.

Branched chained alcohols are made by the "OXO" process. Depending upon the desired effect to be achieved, the substantially branched chain alcohols can be used following alkoxylation and sulfation to lower the viscosity of a composition to a greater extent than do the unbranched alcohols similarly processed. However, the highly branched materials are less biodegradable due to the branching such that the essentially linear alcohols are desirable if biodegradability is of great concern. When such branching is desired, it is preferred that the weight percent of branched alcohols be from about 15% to 75%, preferably from about 20% to 50% by weight of the alkyl chain distribution present in the alcohol. The less branched chain alcohols, when processed into the alkoxylated sulfated form, provide greater suds stability than do the more branched chain materials.

The alkoxylation of the alcohols described above will be generally carried out by one of two methods.

The first method of preparing the ethoxylated alcohol is described in British Pat. No. 757,937, published Sept. 26, 1956 to Kosmin, herein incorporated by reference.

The method taught in the Kosmin British patent is that of reacting a fatty alcohol with ethylene oxide gas at a temperature of from about 120° C to about 150° C in the presence of a small amount of an alkaline catalyst, such as an alkali metal hydroxide or the corresponding methylates. If the alkoxy unit to be added to the alcohol is the isopropoxy radical, the starting material in Kosmin, is the methyl derivative of ethylene oxide. The preferred alkoxy monomer is the unsubstituted ethylene oxide.

When the Kosmin method of preparing the alkoxy condensation product with the alcohol is used, the molar distribution of alkoxy units per mole of fatty alcohol is quite broad. That is to say that the base catalyzed reaction of Kosmin is such that the mono-alkoxylated fatty alcohol is as likely to be reacted with another mole of the alkoxy starting material to form a higher alkoxylated alcohol as the starting fatty alcohol is to react to form the mono-alkoxylated product. The wide distribution of the alkoxy condensation product, prepared according to Kosmin, is seen in Table I, supra.

A second process for the manufacture of the alkoxylated alcohol is described in U.S. Pat. No. 2,870,220, issued Jan. 20, 1959 to Carter, herein incorporated by reference. The Carter process first teaches that primary and secondary alcohols having 10–17 carbon atoms can be readily converted at a high yield into the corresponding mono-alkoxylated alcohols. The mono-alkoxylation is accomplished by reacting the alcohol with the alkoxy monomer by use of acidic catalysts, such as the fluorides and chlorides of boron, aluminum, iron, tin, and titanium. Further catalysts taught by Carter include sulfuric and phosphoric acids as well as the complexes of the aforementioned halides with ethyl ether.

The Carter patent is of particular interest in that a large proportion of the mono-alkoxylated alcohol is formed which may then be converted to the desired sulfate of the present invention. As an additional point of interest, Carter also discloses that the mono-alkoxylated alcohol may be removed from the reaction vessel and then converted to higher alkoxylated alcohols in a base process similar to that of Kosmin previously described.

It was previously stated that a higher proportion of the mono-alkoxylated decyl alcohol sulfate is in the end product. Thus, distillation of the unreacted alcohol or higher alkoxylates may be necessary to achieve the benefits of the present invention. The purpose in removing the unreacted alcohol is to avoid the skin irritancy caused by the alcohol sulfate in the mixture following sulfation. The amount of unreacted alcohol remaining should not be more than about 25%, preferably less than 15% by weight of the finished composition. The higher alkoxylates of the fatty alcohol sulfates have been found not to be as effective in cleaning, thus minimizing their content is desirable.

The stripping off of the unalkoxylated alcohol is carried out by fractional distillation wherein the alcohol evaporates at higher pressures and lower temperatures than does the alkoxylated species. Generally, alkoxylated alcohols having a high alkoxy content will evaporate only at higher temperatures and lower pressures than the alcohols having a lower alkoxy content. Thus it is possible on a continuous basis to strip off the unalkoxylated alcohol for further processing while separating the desired mono-alkoxylate from the higher alkoxylates. One such method of distilling or stripping lower alkoxylated alcohols from the higher alkoxylated species is discussed in U.S. Pat. No. 3,682,849 to Smith et al issued Aug. 8, 1972, herein incorporated by reference.

The selective alkoxylation combined with stripping if necessary gives the desired content of at least about 20% by weight of the decyl alcohol mono-alkoxylate for sulfation based on the weight of the corresponding sulfate. Preferably the amount of decyl alcohol mono-alkoxylate to be sulfated will be about 25% but not more than about 50% by weight of the mixture of decyl alcohol alkoxy sulfates present in the composition.

The sulfation of the decyl alcohol alkoxylates is carried out by the use of known sulfating agents. The sulfating agents include sulfuric acid, oleum, chlorosulfonic acid, and sulfur trioxide. The apparatus and processing techniques employed economically to sulfate the alkoxylated alcohols described above include falling film reactors such as are described in U.S. Pat. Nos. 3,346,505; 3,309,392; 3,531,518; and 3,535,339, herein incorporated by reference.

After the alkoxylated alcohols of the present invention have been sulfated they are neutralized with a water-soluble salt forming cation. Such cations include for example, but are not limited to, sodium, potassium, ammonium, and substituted ammonium cations such as the mono-, di-, and tri- ethanolammonium radicals. Preferably, however, the sulfated alkoxylated alcohol is neutralized with the sodium, potassium, or ammonium cation. The neutralization of the alkyl alkoxy sulfate (organic sulfuric acid) formed in the sulfation process is carried out by using the strong base having the corresponding cation of the desired organic sulfate to be formed. Thus sodium hydroxide is preferably used to neutralize the sulfated alkoxylated alcohol to form the sodium salt thereof.

The amount of water in the present invention is desirably sufficient to ensure that the composition be soluble and free flowing. Generally the amount of water will be from about 20% to about 90%, preferably from about 20% to about 70% by weight, and most preferably from about 30% to 60% by weight.

Optional Ingredients

While the present invention is basically concerned with the unexpected benefits of using a high percentage of the decyl alcohol mono-alkoxylated sulfate salt as the detergent active additional ingredients can be added for various purposes.

Among the preferred ingredients which are advantageously included in the present compositions are mixtures of additional detergent active material such as those discussed in U.S. Pat. No. 3,852,211 to Ohren, issued Dec. 3, 1974, herein incorporated by reference.

A particularly desirable detergent active which may be readily incorporated into the present invention is a mixture of alkyl alkoxy sulfate salts making up from about 5% to about 65%, preferably 10% to 25% by weight of the composition, and having from about 12 to about 18 carbon atoms in the alkyl radical and from about 1 to about 30 moles of alkoxy per alkyl radical. Particularly advantageous in the present invention is the incorporation of from about 5% to to about 65% by weight of a mixture of alcohol ethoxy sulfates having a mean ethoxy content of 5 or greater, preferably in a ratio to the stated decyl alcohol mono-ethoxy sulfate of from about 2:1 to about 1:4. The higher ethoxylates enhance the mildness of the invention.

Another useful detergent component of the present invention includes a mixture of alkyl glyceryl sulfonates having cation similar to those of the decyl alcohol alkoxy sulfates. The alkyl glyceryl sulfonates have an alkyl radical of from about 10 to about 18 carbon atoms, preferably from about 10 to 14 carbon atoms, and from about 1 to 20, preferably from about 2 to 4 glyceryl units per alkyl radical. The alkyl glyceryl sulfonates or mixtures thereof make up from about 1% to about 20%, preferably from about 3% to about 9% by weight of the composition. A desired weight ratio of the decyl alcohol mono-alkoxylate sulfate to the alkyl glyceryl sulfonate is from about 10:1 to about 1:1, preferably from about 5:1 to about 2:1.

Another useful component in the present invention is a tertiary amine oxide having one long chain alkyl radical and two short chain alkyl radicals. The long chain alkyl radical of the tertiary amine oxide has from about 10 to about 18 carbon atoms while the short chain radicals have from about 1 to 3 carbons each. Preferred tertiary amine oxides are described in the Eaton and Gebhardt patent, previously incorporated by reference.

The tertiary amine oxide is present at from about 2% to about 25% by weight of the composition, preferably from about 3% to about 10% by weight. A particularly useful embodiment is where the weight ratio of the alkyl alkoxy sulfate to the amine oxide is from about 1:1 to about 7:1. Nonionic detergents other than the tertiary amine oxides are also desirably included in the present invention at the levels mentioned for or in addition to the tertiary amine oxide. One particularly preferable nonionic detergent is the unsulfated alkoxylated alcohol corresponding to the alkyl alkoxy sulfate previously described.

The liquid detergent composition of the present invention may also contain organic and inorganic detergent builders at a level of from about 3% to about 40%, preferably from about 5 to about 15% by weight of the total composition. Examples of such organic or inorganic detergent builders include the alkali metal and ammonium citrates, pyrophosphates, and alpha-sulfocarboxylates. A particularly preferred compound is trisodium citrate which is also particularly useful in peptizing the protein soil from the surfaces of dishes.

It is also desirable in order to achieve a greater degree of suds stability during the use of the composition to include therein from about 0.5% to about 10%, preferably from about 1 to 4% by weight of a water-soluble salt having a divalent or trivalent cation (e.g. water hardness). Examples of such water-soluble salts include the chlorides and sulfates of copper, zinc, iron, aluminum, calcium, and magnesium. Particularly useful are the magnesium chlorides and sulfates. Of particular interest in the present invention is the observation that unlike other compositions the present invention does not suffer a substantial decrease in the initial suds generation upon the addition of the aforementioned hardness ions.

Other useful components in the present invention include solubilizing agents such as the alkali metal and ammonium salts of benzene-, cumene-, and toluenesulfonates, and such viscosity reducing aids as potassium chloride and lower alcohols such as methanol, ethanol, and isopropanol. The foregoing may be present at from about 1% to about 20%, preferably from about 2% to about 10% by weight.

The following are examples of the present invention:

EXAMPLE I

The following compositions are prepared according to the formula:

| | |
|---|---|
| $C_yE_xSO_4^-(NH_4)^+$ | 25% |
| Na coconut* glyceryl sulfonate | 4% |
| Coconut* dimethylamine oxide | 5% |
| Water | 66% |

*Where coconut is used the alkyl portion is that given in Table I.

The formula given above is used in Table II below where $C_Y$ indicates the alkyl chain length and $E_x$ is the number of moles of ethoxylate per mole alkyl.

Table II

| | Cleaning Scores (Standard Deviation = 0.6) Number of Ethoxy Group, x | | | | |
|---|---|---|---|---|---|
| $C_y$ | 0 | 1 | 2 | 3 | 4 |
| $C_8$ | .53 | | | | |
| $C_{10}$ | .28 | .13 | .43 | .31 | .46 |
| $C_{11}$ | .08 | | .29 | | .36 |
| $C_{12}$ | .13 | .26 | .30 | .35 | .40 |
| $C_{13}$ | .13 | | .31 | | .38 |
| $C_{14}$ | .30 | .28 | .34 | .37 | .37 |
| $C_{16}$ | .47 | .44 | .27 | .50 | .61 |

The compositions of Table II are tested at usage levels of 0.01, 0.02, and 0.04% by weight of a dishwashing solution at a water hardness of 1.5, 6.0, and 10.5 grains (as $CaCO_3$) per gallon with the calcium/magnesium ratio at 1:1. The cleaning scores given for the various components above are a composite of the colorimeter haze readings at each soak concentration. The individual cleaning scores are determined by soiling virgin glass microscope slides with a mixture of whole white milk and French's gravy. The solid slides are then tested at the various concentrations and hardness levels by soaking for 3½ minutes at 115° F. The slides are then removed without rinsing and allowed to air dry overnight. The haze readings are taken on each slide the following day with a Hunter Lab Colorimeter. The haze reading themselves are the diffused transmitted light divided by the diffused plus specular transmitted light. A "clean" slide will exhibit very little diffused transmitted light and mostly specular transmitted light. Thus a clean slide will have a hazed reading near zero and a soiled slide near one.

The decyl mono-ethoxylated sulfate in Table II is superior in cleaning to the di-, tri-, and tetra-ethoxylated sulfates of decyl alcohol. It is most surprising however, that the mono-ethoxylated decyl alcohol sulfate cleans superior to the decyl alcohol sulfate. In every other example tested in Table II the mono-ethoxylated sulfate cleans no better than but sometimes worse than the corresponding unethoxylated alcohol sulfate.

Moreover, not only does the decyl mono-ethoxylate alcohol sulfate clean significantly better than the unethoxylated alcohol but the former is considerably milder to human skin than the corresponding sulfated alcohol.

Substantially similar results are obtained when a mixture of decyl alcohol ethoxylated sulfates are employed provided that at least about 20% by weight of the decyl alcohol ethoxylated sulfates are mono-ethoxylated.

EXAMPLE II

The following compositions are prepared:

| | A | B |
|---|---|---|
| Coconut triethoxy $SO_4^-NH_4^+$** | 25% | — |
| $C_yE_1^-SO_4^-NH_4^+$*** | — | 20% |
| Coconut dodecyl ethoxy $SO_4^-NH^+$**** | — | 5% |
| $CaCl_2 \cdot 2H_2O$ | — | 9% |
| Sodium coconut glyceryl sulfate | 4% | 4% |
| Coconut dimethyl amine oxide | 5% | 5% |
| Water | Balance | |

*See Table I for distribution and ethoxylate range.
**Mean ethoxy content of one and having 20% $C_{10}$/52%, $C_{12}$/ 22%, $C_{14}$/ 6%, $C_{16}$ with about 25% mono-ethoxylate for each chain length.
***Mean ethoxy content of twelve.

Figure 2:
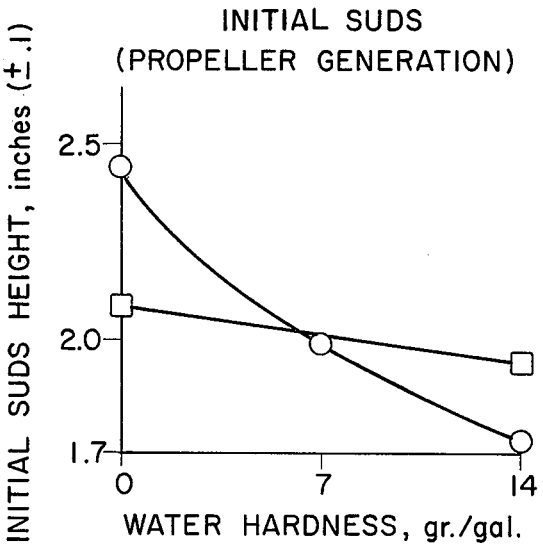

Formulas A and B are tested for cleaning, suds stability, and initial suds generation. FIGS. 1 and 2 represent respectively soft water sudsing and initial suds generation of comparative formulas A and B.

The suds during wash (SDW) is measured by averaging the suds in a dishpan by handwashing 30 plates soiled with Fluffo Shortening and Prep oil. The plates are washed in a metal dishpan containing 0.185% of each test composition in one gallon of water at a neutral pH. The wash solution temperature starts at 115° F and will drop approximately 8° to 12° during the test. The suds-height measurement is recorded in inches after the initial suds generation and at each five plate interval. The initial suds generation is accomplished either by falling water or by use of a mechanical propeller to insure uniformity.

The suds during wash or SDW score is the averaged sum of the initial suds height and the suds height after the fifth, tenth, fifteenth, twentieth, twenty-fifth, and thirtieth plate has been washed divided by seven times the initial suds height. This fraction times 100 gives a percentage of the initial suds remaining throughout the course of the wash. Thus the higher the SDW score the greater the amount of suds remaining in the dishpan after the wash.

As was noted previously, di- and tri-valent cations notably calcium and magnesium, have a tendency to increase SDW scores as the cation content increases. It was also noted that the addition of the di- and tri-valent cations interferred significantly with the initial suds generation. In FIGS. 1 and 2, Composition A of the prior art is represented on the curves by the dotted circles and Composition B of the present invention by the rectangles. It is thus seen from FIGS. 1 and 2 that Composition B of the present invention performs superior with respect to maintaining suds during the wash (SDW) while maintaining a more even distribution of initial suds generation when both tests are measured over varying water hardness.

The benefits of the present invention thus include the fact that a single formulation according to the present invention may be marketed over several areas of the nation where the water hardness will range between 0 and 14 grains per gallon without substantial loss of the initial suds generation while maintaining a greater level of suds during the wash (SDW). Moreover, Composition B provides comparable cleaning benefits when compared to Composition A despite the fact that Composition B contains a source of hardness ions which are known to interfere with detergent performance. Furthermore, Composition B of the present invention contains a large percentage of coconut dodecylethoxy ammonium sulfate which is known as a mildness additive but which is not a particularly effective detergent component.

EXAMPLE III

Compositions C and D are prepared, Composition C contains as $C_yE_xSO_4^-NH_4^+$, $C_{10}E_1$- $SO_4^-NH_4^+$according to the present invention. Composition D contains $C_{10}E_3$- $SO_4^-NH_4^+$. The remainder of each formula is a varying percentage of the corresponding coconut (85% $C_{12}$/15% $C_{14}$) ethoxylate ($E_1$- or $E_3$-) ammonium sulfate. The constant ingredients in C and D are coconut* alkyl glyceryl sulfate at 4% and coconut* dimethyl amine oxide at 5% with the balance water.

* see Table III for distribution of coconut alkyl.

Table III and Table IV below indicate the differences between the decyl mono-ethoxylate (C) and the decyl tri-ethoxylate (D) ammonium sulfates. The first column in Table III and Table IV gives the weight percent on a finished product basis of the decyl tri-ethoxylate and the decyl mono-ethoxylate ammonium sulfate respectively while the second column gives the percentage in the composition of the $C_{12}/C_{14}$ ethoxylated ammonium sulfate.

It is seen from Tables III and IV that the suds stability as measured by the SDW scores discussed previously, that the decyl mono-ethoxylate ammonium sulfate performs better alone and in mixtures with other ethoxylated sulfates than does the decyl tri-ethoxylated ammonium sulfate under the same conditions. Initial suds generation is approximately equal for Compositions C and D.

Table III

| $C_{10}E_3^-SO_4^-NH_4^+$ | $(C_{12}/C_{14})E_3^-SO_4^-NH_4^+$ | (gr./gal.) Water Hardness | SDW Scores (±2) | (±.1) Initial* Suds (inches) |
|---|---|---|---|---|
| 0 | 20 | 0 | 37 | 2.5 |
| | | 7 | 46 | 2.2 |
| 2 | 18 | 0 | 36 | 2.5 |
| | | 7 | 46 | 2.2 |
| 4 | 16 | 0 | 38 | 2.4 |
| | | 7 | 46 | 2.0 |
| 6 | 14 | 0 | 36 | 2.4 |
| | | 7 | 45 | 2.3 |
| 20 | 0 | 0 | 30 | 2.1 |
| | | 7 | 36 | 2.3 |

*Propeller suds generation (30 seconds)

Table IV

| $C_{10}E_1^-SO_4^-NH_4^+$ | $(C_{12}/C_{14})E_1^-SO_4^-NH_4^+$ | (gr./gal.) Water Hardness | SDW Scores (± 2) | (±.1) Initial* Suds (inches) |
|---|---|---|---|---|
| 0 | 20 | 0 | 37 | 2.5 |
| | | 7 | 51 | 2.0 |
| 2 | 18 | 0 | 37 | 2.6 |
| | | 7 | 52 | 2.2 |
| 4 | 16 | 0 | 38 | 2.4 |
| | | 7 | 49 | 2.4 |
| 6 | 14 | 0 | 37 | 2.3 |
| | | 7 | 50 | 2.1 |
| 20 | 0 | 0 | 34 | 1.8 |

Table IV-continued

| $C_{10}E_1^-SO_4^-NH_4^+$ | $(C_{12}/C_{14})E_1^-SO_4^-NH_4^+$ | (gr./gal.) Water Hardness | SDW Scores (± 2) | (±.1) Initial* Suds (inches) |
|---|---|---|---|---|
| | | 7 | 45 | /1.9 |

*Propeller suds generation (30 seconds)

| | |
|---|---|
| $C_yE_xSO_4^-NH_4^+$ | 25.0 |
| Coconut* alkyl glycerol sulfonate | 4.0 |
| Coconut* dimethyl amine oxide | 5.0 |
| Potassium chloride | 3.3 |
| Ethaol | 7.0 |
| Potassium toluene sulfonate | 0.25 |
| Water | 55.45 |
| | 100.0% |

*See Table I for coconut distribution.

In E, $C_y$ is decyl ($C_{10}$); F is dodecyl ($C_{12}$); and G is tetradecyl ($C_{14}$).

Compositions E, F, and G are tested for their tendency to irritate human skin. The irritancy test is carried out by diluting each respective composition to a standard concentration in this case 2%. A sample of each diluted composition is then saturated on a gauze patch which is secured to a panelist's back for 24 hours. After 24 hours the test patches are removed and the irritated spot is graded following an additional 24 hour waiting period. Irritancy scores range from 0 to 4 with 4 being irritating and 0 being quite mild.

Figure 3:
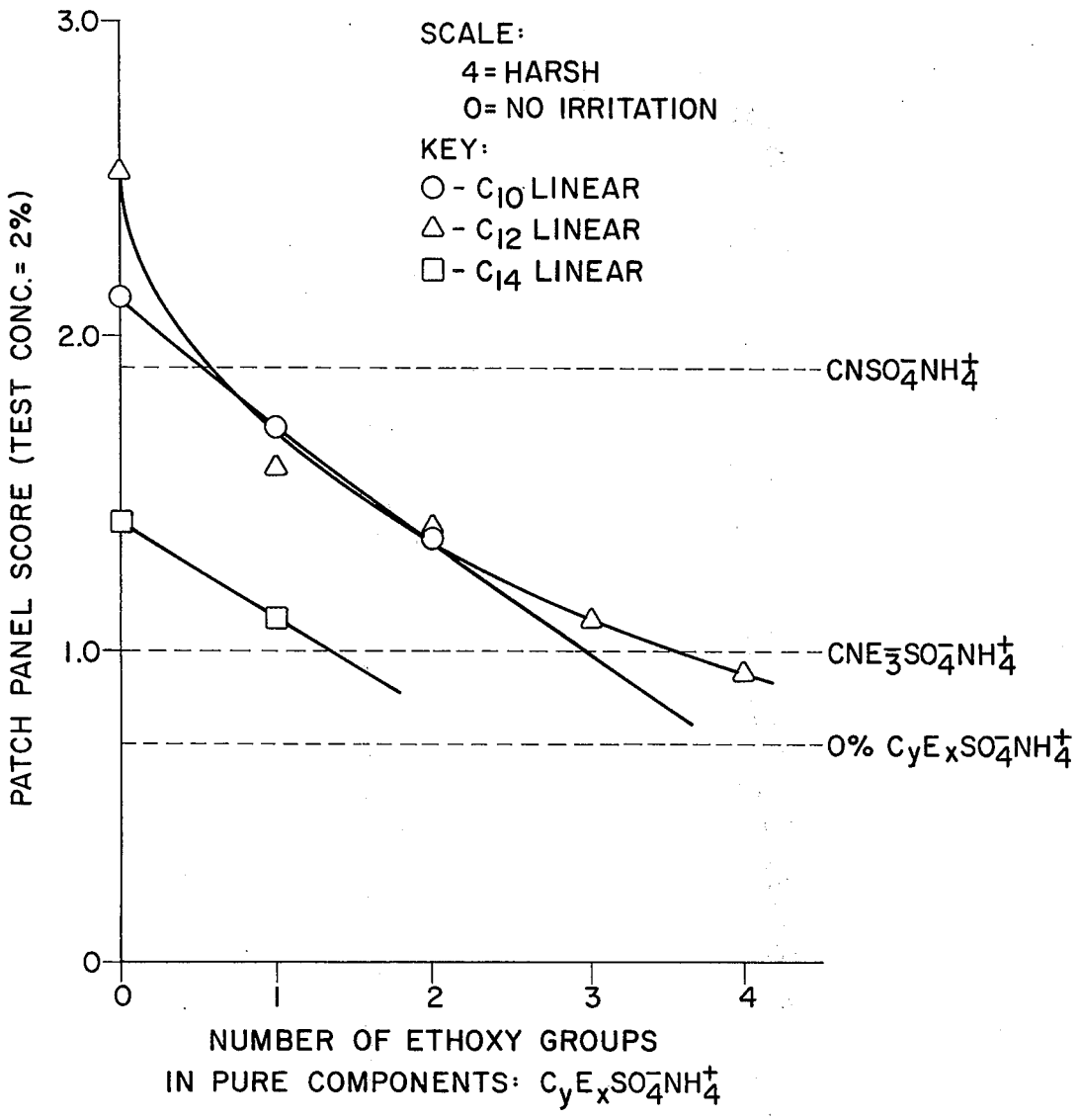

FIG. 3 graphically represents Compositions E, F, and G at ethoxylate contents of from 0 to 4.

The curve representing the decyl ethoxylate ammonium sulfate is shown by the circle, while the dodecyl is given by the triangular symbol and the tetradecyl by the rectangular symbol. Also shown as reference marks on FIG. 3 are three horizontal lines representing ammonium salt of coconut alcohol sulfate (not ethoxylated); coconut triethoxy ammonium sulfate and a base line which represents Compositions E, F, and G having no $C_yE_xSO_4^-NH_4^+$.

Thus the lowest horizontal line on FIG. 3 relates to the base line described above containing no alkyl ethoxy sulfate material such that the only variable at any point is the $C_yE_xSO_4^-NH_4^+$. The intermediate base line represents a coconut cut triethoxy ammonium sulfate which is mild to the skin but is not particularly effective in cleaning. The highest horizontal line represents the unethoxylated ammonium salt of coconut alkyl sulfate which while cleaning better than the coconut triethoxy ammonium sulfate is considerably harsher to the skin.

FIG. 3 shows that the decyl mono-ethoxylated ammonium sulfate of Composition E is as mild to the skin as the dodecyl mono-ethoxy ammonium sulfate. Moreover, the decyl version in Composition E cleans and suds significantly better than the dodecyl version of Composition F. Composition G ($C_{14}E_xSO_4^-NH_4^+$) while mild is a significantly poor cleaner and sudser than either the decyl or dodecyl versions of Compositions E and F, respectively.

While FIG. 3 was carried out for pure components of definite alkyl chain length and of ethoxylate content it becomes evident that the decyl mono-ethoxylated ammonium sulfate can advantageously be added to detergent compositions to improve cleaning ability and sudsing without a substantial loss in skin mildness.

EXAMPLE V

A light-duty liquid detergent composition is prepared containing:

| | |
|---|---|
| Sodium decyl alcohol monoethoxy sulfate | 50% |
| Sodium decyl alcohol diethoxy sulfate | 15% |
| Sodium decyl alcohol triethoxy sulfate | 15% |
| Water | 20% |

This product cleans soiled dishes satisfactorily while generating and maintaining adequate suds and is mild to human skin.

The above example is modified with satisfactory results by replacing some of the sodium decyl alcohol diethoxy sulfate with 3% and then 40% trisodium citrate. The first example is again modified with satisfactory results by lowering the total decyl alcohol ethoxy sulfate content to 4% of the total composition while maintaining the respective ratios of the decyl alcohol alkoxy sulfate mixture with the balance being water.

Each of the above may be further modified with satisfactory results by substituting isopropoxy radicals for the ethoxy radical.

What is claimed is:

1. A liquid detergent composition comprising:

a. from about 4% to about 80% by weight of a mixture of decyl alcohol alkoxy sulfates wherein the alkoxy radical is selected from the group consisting of ethoxy and isopropoxy radicals and mixtures thereof having a mean alkoxy content of from about one to about four wherein at least about 20% by weight of the decyl alcohol alkoxy sulfates are monoalkoxylated and, b. from about 20% to about 96% by weight water.

2. The composition of claim 1 wherein the alkoxy radical is the ethoxy radical.

3. The composition of claim 2 wherein the cation of the decyl alcohol ethoxy sulfate is selected from the group consisting of sodium, potassium and ammonium and mixtures thereof.

4. The composition of claim 3 wherein the decyl alcohol monoethoxylated sulfate is at least about 25% by weight of the decyl alcohol alkoxy sulfates.

5. The composition of claim 4 additionally comprising from 3% to 40% by weight of a member selected from the group consisting of organic and inorganic detergent builders.

6. The composition of claim 5 wherein the detergent builders are selected from the group consisting of alkali metal citrates, pyrophosphates and alpha-sulfocarboxylates.

7. The composition of claim 4 wherein the cation is ammonium.

8. The composition of claim 4 wherein the cation is potassium.

9. The composition of claim 4 wherein the cation is sodium.

10. The composition of claim 9 additionally comprising from about 0.5% to about 10% by weight of a member selected from the group consisting of water-soluble salts having divalent and trivalent cations.

11. The composition of claim 10 wherein the water-soluble salts are selected from the group consisting of the cations of copper, iron, zinc, aluminum, calcium and magnesium and the anion is selected from the group consisting of chlorides and sulfates, and mixtures thereof.

12. The composition of claim 11 wherein the water-soluble salt is selected from the group consisting of magnesium chloride and magnesium sulfate and mixtures thereof.

13. The composition of claim 12 wherein the decyl alcohol monoethoxylated sulfate is at least about 25% by weight of the decyl alcohol ethoxy sulfate.

14. The composition of claim 13 additionally comprising from about 2% to about 10% by weight of potassium chloride.

15. The composition of claim 14 comprising from about 1% to about 20% by weight of an additional anionic detergent.

16. The composition of claim 15 wherein the additional anionic detergent is an alkyl glyceryl sulfonate.

17. The composition of claim 14 additionally comprising from about 2% to about 25% by weight of a nonionic detergent.

18. The composition of claim 17 wherein the additional nonionic detergent is a tertiary amine oxide.

19. The composition of claim 17 wherein the additional nonionic detergent is an ethoxylated alcohol.

20. A liquid detergent composition comprising a. from about 15% to about 60% by weight of a decyl alcohol ethoxy sulfate having a mean ethoxylate content of from about 1 to about 4 wherein at least 25% by weight of the decyl alcohol ethoxy sulfates are mono-ethoxylated;

b. from about 5% to about 65% by weight of a mixture of alcohol ethoxy sulfates having an alkyl chain of from about 12 to about 20 and a mean ethoxy content of 5 or greater; and c. from about 20% to about 70% by weight water.

21. The composition of claim 20 wherein the weight ratio of component (a) to component (b) is from about 2:1 to about 1:4.

22. The composition of claim 21 additionally comprising from about 1% to about 4% by weight of a member selected from the group consisting of magnesium chloride and magnesium sulfate.

23. The composition of claim 22 additionally comprising from about 5% to about 15% by weight of a water-soluble citric acid salt.

24. The composition of claim 22 additionally comprising from about 3% to about 10% by weight of a tertiary amine oxide and from about 3% to about 9% by weight of an alkyl glyceryl ether sulfonate.

* * * * *